US008702224B2

(12) United States Patent
Ohnishi

(10) Patent No.: US 8,702,224 B2
(45) Date of Patent: Apr. 22, 2014

(54) INKJET PRINTER AND PRINTING METHOD

(75) Inventor: Masaru Ohnishi, Nagano (JP)

(73) Assignee: Mimaki Engineering Co., Ltd., Nagano (JP)

( * ) Notice: Subject to any disclaimer, the term of this patent is extended or adjusted under 35 U.S.C. 154(b) by 160 days.

(21) Appl. No.: 13/203,484

(22) PCT Filed: Feb. 17, 2010

(86) PCT No.: PCT/JP2010/000969

§ 371 (c)(1),
(2), (4) Date: Aug. 25, 2011

(87) PCT Pub. No.: WO2010/098041

PCT Pub. Date: Sep. 2, 2010

(65) Prior Publication Data

US 2011/0310204 A1 Dec. 22, 2011

(30) Foreign Application Priority Data

Feb. 27, 2009 (JP) ..... 2009-045575

(51) Int. Cl.
*B41J 2/01* (2006.01)

(52) U.S. Cl.
USPC ..... 347/102

(58) Field of Classification Search
None
See application file for complete search history.

(56) References Cited

U.S. PATENT DOCUMENTS

| | | | | |
|---|---|---|---|---|
| 2007/0024686 | A1* | 2/2007 | Kadomatsu et al. | 347/102 |
| 2007/0176995 | A1* | 8/2007 | Kadomatsu et al. | 347/103 |
| 2008/0225100 | A1* | 9/2008 | Kumagai | 347/102 |

FOREIGN PATENT DOCUMENTS

| | | |
|---|---|---|
| JP | 2003-089198 | 3/2003 |
| JP | 2005-280245 | 10/2005 |
| JP | 2006-015691 | 1/2006 |
| JP | 2007-030464 | 2/2007 |

* cited by examiner

*Primary Examiner* — Stephen Meier
*Assistant Examiner* — Alexander C Witkowski
(74) *Attorney, Agent, or Firm* — Jianq Chyun IP Office

(57) ABSTRACT

To provide a printing method that enhances bonding between a colored-ink layer and an overprint layer, flatten a surface of the overprint layer, and make it possible to print glossy images or decorative colors when performing overprinting on a colored ink print using an inkjet printer.

The printing method includes sequentially performing: Step (1) of forming a UV curable colored-ink layer on a surface of a recording medium; Step (2) of irradiating the colored-ink layer with a weak UV light; Step (3) of forming an overprint layer on the colored-ink layer; Step (4) of flattening the surface of the overprint layer after allowing a predetermined time to elapse; Step (5) of irradiating the colored-ink layer and the overprint layer with a weak UV light; and Step (6) of irradiating the colored-ink layer and the overprint layer with a strong UV light to cure the colored-ink layer and the overprint layer.

8 Claims, 4 Drawing Sheets

INKJET PRINTER AND PRINTING METHOD

CROSS-REFERENCE TO RELATED APPLICATION

This application is a 371 of international application of PCT application serial no. PCT/JP2010/000969, filed on Feb. 17, 2010, which claims the priority benefit of Japan application no. 2009-045575, filed on Feb. 27, 2009. The entirety of each of the above-mentioned patent applications is hereby incorporated by reference herein and made a part of this specification.

TECHNICAL FIELD

The present disclosure relates to an inkjet printer and a printing method that use a UV curable ink (a type of ink that is cured by irradiating with an ultraviolet light). More particularly, the present disclosure relates to an inkjet printer and a printing method that can secure a bonding strength between a colored-ink layer and an overprint layer, enhance flatness and glossiness of a surface of the overprint layer when performing overprinting.

BACKGROUND ART

An inkjet printer that uses a UV curable ink is known in the art.

Ink dots that constitute images or characters that are printed on a surface of a recording medium by the inkjet printer that uses the UV curable ink are deposited on the surface of the recording medium in a bulging state in a semispherical shape or a substantially semispherical shape. Due to such a shape of the dots, a light is diffusely reflected by the surface, and the surface of the printed images or characters lacks glossiness. As a result, a quality of an image degrades.

To enhance the glossiness of the surface of the printed images and/or characters by preventing diffused reflection of the light from the surface of the images and/or characters, a technology is disclosed in Patent Document 1 in which a transparent or a semitransparent clear coat layer is formed on the ink dots that constitute the images and/or characters.

To prevent mixing of a clear ink or an opaque ink, such as a white ink and a metallic ink, used in such an over coat with other colored inks such as YMCK, overprinting, that is, reprinting is generally performed after the colored ink is printed.

However, if the colored ink is in a completely cured state at the time of performing overprinting on a colored ink print using a UV printer, the ink used in the overprinting repels the colored ink. This leads to reduction in a bonding strength between both the inks, or the ink used in the overprinting coagulates on the colored ink in the form of droplets, forming what is called beading, and printing cannot be performed uniformly.

CONVENTIONAL ART DOCUMENTS

Patent Documents

[Patent Document 1] Japanese Patent Application Laid-open No. 2006-15691

DISCLOSURE OF INVENTION

Problem to be Solved by the Invention

The present disclosure is made in view of the above discussion and it is one object of the present disclosure to provide an inkjet printer that can enhance bonding between a colored-ink layer and an overprint layer, flatten the surface of the overprint layer, and make it possible to print glossy images and decorative colors when performing overprinting on the colored ink.

Furthermore, it is another object of the present disclosure to provide a printing method that can enhance bonding between the colored-ink layer and the overprint layer, flatten the surface of the overprint layer, and make it possible to print glossy images and decorative colors when performing overprinting on the colored ink using the inkjet printer.

Means for Solving Problems

To achieve the above object, an inkjet printer according to Claim 1 uses a UV curable ink and at least includes a first print head that discharges droplets of a plurality of UV curable colored inks on a surface of a recording medium and prints images and/or characters formed of an array of dots of the ink droplets; a first UV-light irradiating unit that irradiates on a colored-ink layer formed of the dots of the colored ink a weak UV light so as not to cure the colored-ink layer completely; a second print head that discharges droplets of a UV curable transparent or semitransparent overprint ink on the colored-ink layer, and forms an overprint layer; a second UV-light irradiating unit that irradiates on the colored-ink layer and the overprint layer a weak UV light so as not to cure the colored-ink layer and the overprint layer completely; and a third UV-light irradiating unit that irradiates on the colored-ink layer and the overprint layer a strong UV light sufficient for curing the colored-ink layer and the overprint layer.

The inkjet printer according to Claim 2 of the present disclosure, in the inkjet printer according to Claim 1, the first and/or second UV-light irradiating unit irradiates a UV light having an intensity that is half of or less than half of that of the UV light irradiated from the third-UV-light irradiating unit.

The inkjet printer according to Claim 3 of the present disclosure, in the inkjet printer according to Claim 1 or 2, the first print head also includes functions of the second print head, and the first print head discharges the droplets of the overprint ink and forms the overprint layer.

The inkjet printer according to Claim 4 of the present disclosure, in the inkjet printer according to Claim 3, the first UV-light irradiating unit also includes functions of the second UV-light irradiating unit, and the first UV-light irradiating unit irradiates a very weak UV light when the overprint layer is formed by the first print head.

A printing method according to Claim 5 of the present disclosure includes a first step of printing images and/or characters formed of an array of dots of a plurality of UV curable colored inks on a surface of a recording medium using an inkjet printer that uses a UV curable ink; a second step of irradiating a colored-ink layer formed of the dots of the colored inks with a weak UV light so as not to cure the colored-ink layer completely; a third step of forming an overprint layer using a UV curable transparent or semitransparent overprint ink on the colored-ink layer; a fourth step of flattening a surface of the overprint layer after allowing a predetermined time to elapse; a fifth step of irradiating the colored-ink layer and the overprint layer with the weak UV light so as not to cure the colored-ink layer and the overprint layer completely; and a sixth step of irradiating the colored-ink layer and the overprint layer with a strong UV light sufficient for curing the colored-ink layer and the overprint layer.

The printing method according to Claim 6 of the present disclosure, in the printing method according to Claim 5, an intensity of the weak UV light is half of or less than half of that of the strong UV light.

Advantages of the Invention

In an inkjet printer according to the present disclosure, a colored-ink layer can be partially cured by irradiating with a weak UV light from a first UV-light irradiating unit. Furthermore, by forming an overprint layer on the colored-ink layer, a contact angle between the colored ink and the overprint ink can be reduced, and a better bonding can be achieved between both the inks. Formation of a hard strip can be suppressed by irradiating the colored-ink layer and the overprint layer with a weak UV light from a second UV-light irradiating unit before irradiating with a strong UV light from a third UV-light irradiating unit.

Thereafter, an overprint layer having a flat surface can be obtained by curing the colored-ink layer and the overprint layer by the third UV-light irradiating unit. Thus, scattering of light on a surface of dots of a plurality of inks forming the colored-ink layer can be suppressed. Furthermore, glossiness of a surface of images and/or characters covered by the overprint layer can be increased and the quality of the images and/or characters can be enhanced.

As a result, in the present disclosure, an inkjet printer that can secure a bonding strength between the colored-ink layer and the overprint layer, flatten the surface of the overprint layer, and make it possible to print glossy images and decorative colors can be provided.

In a printing method according to the present disclosure, the surface of the overprint layer is flattened after allowing a predetermined time to elapse after the overprint layer is formed on the colored-ink layer that is partially cured, and the colored-ink layer and the overprint layer are cured. By forming the overprint layer on the colored-ink layer that is partially cured, the contact angle between the colored-ink layer and the overprint layer can be reduced, and a better bonding can be achieved between both the layers. Thereafter, the overprint layer that is less uneven and less bulging can be formed after allowing the predetermined time to elapse.

Formation of a hard strip can be suppressed by irradiating the colored-ink layer and the overprint layer with the weak UV light before irradiating with the strong UV light. Thereafter, the overprint layer having a flat surface can be obtained by curing the colored-ink layer and the overprint layer. Thus, scattering of the light on the surface of the dots of the inks forming the colored-ink layer can be suppressed. Furthermore, the glossiness of the surface of the images and/or characters covered by the overprint layer can be increased, and the quality of the images and/or characters can be enhanced.

As a result, the present disclosure provides a printing method that can secure the bonding strength between the colored-ink layer and the overprint layer, flatten the surface of the overprint layer, and make it possible to print glossy images and decorative colors.

BEST MODE(S) FOR CARRYING OUT THE INVENTION

Exemplary embodiments of the present disclosure are explained in detail below with reference to the accompanying drawings.

Properties of a UV curable ink used in the present disclosure are explained first.

Figure 1:
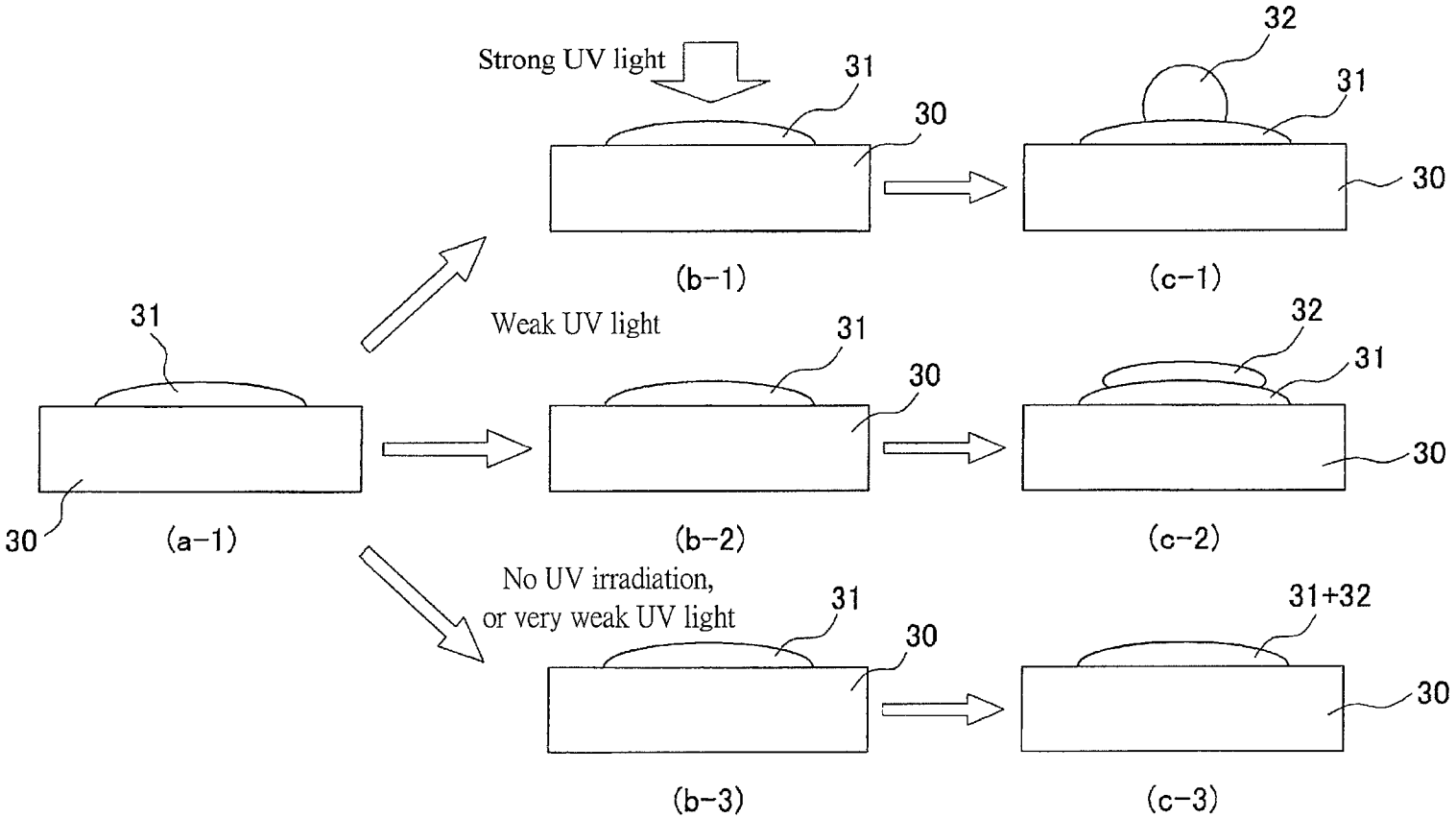
FIG. 1 is a schematic diagram for explaining how the properties of a UV curable colored ink and a clear coat ink change when an irradiation intensity of a UV light is changed.
Figure 2:
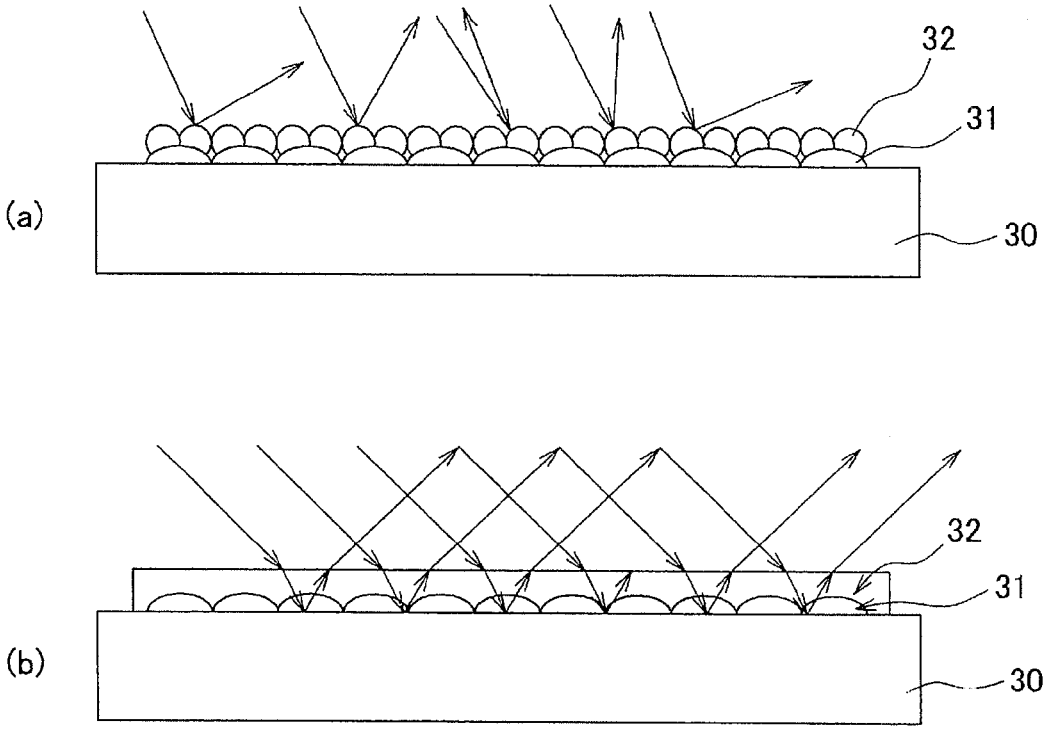
FIG. 2 is a schematic diagram for explaining scattering of light on a surface of a colored-ink layer.

FIG. 1 is a schematic diagram for explaining how properties of a UV curable colored ink 31 and a clear ink 32 change when an irradiation intensity of a UV light is changed. FIG. 2 is a schematic diagram showing scattering of light on a surface of a colored-ink layer.

As one of the properties of the UV curable ink, if printing is performed with the UV curable ink on an ink before irradiation of the UV light and after irradiation of the UV light, spreading of a print dot varies.

As shown in (a-1) of FIG. 1, images and/or characters formed of an array of dots of ink droplets of the colored ink 31 are printed on a surface of a recording medium 30 using the UV curable colored ink 31. In the present disclosure, colored inks of four colors, for example, Y (Yellow), M (Magenta), C (Cyan), and K (Black) are used.

The colored ink 31 is irradiated with the UV light and cured; however, when curing the colored ink 31, the intensity of the UV light is changed as given in the following three steps.

In a first step, as shown in (b-1) of FIG. 1, when the colored ink 31 is irradiated with a sufficiently strong UV light, the UV curable colored ink 31 is completely cured by a rapid photopolymeraization reaction. The colored ink 31, which is completely cured, becomes stable due to high molecular weight, and generally possesses a repellent property toward liquids.

Thus, if printing (overprint) is performed on the colored ink 31, which is in a completely cured state, by superimposing another ink, such as a UV curable clear ink, as shown in (c-1) of FIG. 1, because the cured colored ink 31 repels liquids, a contact angle between the colored ink 31 and the clear ink 32 increases so that the clear ink 32 is printed with a bulging surface. If the clear ink 32 printed as described above is immediately irradiated with the UV light, the surface of the clear ink 32 is unevenly cured (solidified) as shown in (a) in FIG. 2, and because the light is diffusely reflected by the surface of the clear ink 32, a matte image is formed.

In a second step, as shown in (b-2) of FIG. 1, when the colored ink 31 is irradiated with a weak UV light so as not to cure the colored ink 31 completely, the colored ink 31 is partially cured. If printing is performed by superimposing another ink, such as the clear ink 32, on the partially cured colored ink 31, as shown in (c-2) of FIG. 1, a contact angle between the colored ink 31 and the clear ink 32 is reduced, that is, a better bonding is achieved between the colored ink 31 and the clear ink 32. As a result, as shown in (c-2) of FIG. 1, a clear coat layer that is less uneven and less bulging is formed.

In a third step, as shown in (b-3) of FIG. 1, when the colored ink 31 is irradiated with a very weak UV light, the colored ink 31 does not get cured, but remains in a liquid state; however, a viscosity thereof increases to some extent. If printing is performed by superimposing another ink, such as the clear ink 32, on the colored ink 31 that is in the liquid state, as shown in (c-3) of FIG. 1, a contact angle between the colored ink 31 and the clear ink 32, that is, between both the liquids, is greatly reduced. When the UV light is not completely irradiated, because both the inks are homogeneous liquids, the inks mix with each other, and with the passage of time, completely intermingle. When the UV curable ink is not irradiated with the UV light, the appearance of the colored ink 31 and the clear ink 32 with the passage of time is shown in (c-3) of FIG. 1.

The surface of the clear ink 32 is flattened as shown in (b) in FIG. 2 if sufficient time is allowed to elapse after printing the clear ink 32. When the difference in refractive indices of the clear ink 32 and the colored ink 31 becomes negligible because of flattening of the surface, the light does not get scattered on a surface of either of the colored ink 31 and the clear ink 32 as shown in (b) in FIG. 2, and a glossy print can be obtained.

An inkjet printer 1 and a printing method according to the present disclosure are explained next while considering the properties of the UV curable ink described above.

Figure 3:
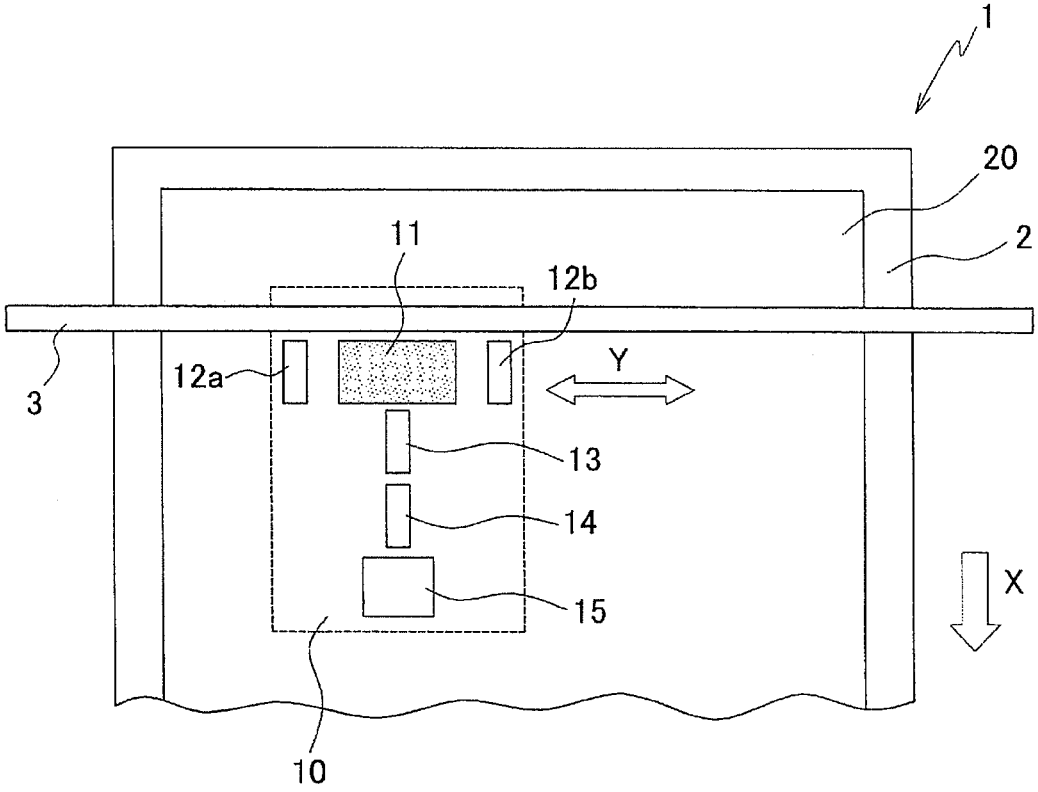
FIG. 3 is a schematic plan view of a configuration example of an inkjet printer according to the present disclosure.

FIG. 3 is a schematic plan view of a configuration example of the inkjet printer 1 according to the present disclosure. In FIG. 3, only a head, which is a characteristic component of the present disclosure, and surrounding components thereof are shown. Rest of the components can be configured in a similar manner to a conventional inkjet printer.

In the following explanation, as an example, a case is explained in which a clear coat layer is formed using a clear ink as an overprint. However, the present disclosure is not limited to this configuration. That is, the present disclosure is also applicable to a case in which, for example, printing is performed by superimposing a colored ink.

The inkjet printer 1 according to the present disclosure uses a UV curable ink. The inkjet printer 1 includes at least a first print head 11, first UV-light irradiating units 12*a* and 12*b*, a second print head 13, a second UV-light irradiating unit 14, and a third UV-light irradiating unit 15. The first print head 11 discharges droplets of a plurality of UV curable colored inks on a surface of a recording medium 20, and prints images and/or characters in the form of an array of dots 21*a* of the ink droplets. The first UV-light irradiating units 12*a* and 12*b* irradiate on a colored-ink layer 21 formed of the dots 21*a* of the colored inks the weak UV light so as not to cure the colored-ink layer 21 completely. The second print head 13 discharges ink droplets of a UV curable transparent or semi-transparent clear ink (overprint ink) on the colored-ink layer 21 and forms a clear coat layer 22 (overprint layer). The second UV-light irradiating unit 14 irradiates on the colored-ink layer 21 and the clear coat layer 22 the weak UV light so as not to cure the colored-ink layer 21 and the clear coat layer 22 completely, and the third UV-light irradiating unit 15 irradiates on the colored-ink layer 21 and the clear coat layer 22 a strong UV light sufficient for curing the colored-ink layer 21 and the clear coat layer 22.

In the inkjet printer 1 according to the present disclosure, the first UV-light irradiating units 12*a* and 12*b* that irradiate the weak UV light partially cure the colored-ink layer 21. Thus, by forming the clear coat layer 22 on the colored-ink layer 21, a contact angle between the colored ink and the clear ink can be reduced and a better bonding can be achieved between the colored ink and the clear ink. Formation of a hard strip can be suppressed by irradiating the colored-ink layer 21 and the clear coat layer 22 with the weak UV light from the second UV-light irradiating unit 14 before irradiating the colored-ink layer 21 and the clear coat layer 22 with the strong UV light from the third UV-light irradiating unit 15.

Thereafter, the clear coat layer 22 having a flat surface can be obtained by curing the colored-ink layer 21 and the clear coat layer 22 by the third UV-light irradiating unit 15. Thus, scattering of the light can be suppressed on the surface of the dots 21*a* of the inks forming the colored-ink layer 21. Consequently, glossiness of the surface of the images and/or characters that is covered by the clear coat layer 22 can be increased and the quality of the images and/or characters can be enhanced.

As a result, the present disclosure provides the inkjet printer 1 that can secure a bonding strength between the colored-ink layer 21 and the clear coat layer 22, flatten the surface of the clear coat layer 22, and make it possible to print the glossy images and the decorative colors.

The inkjet printer 1 that uses the UV curable ink includes, as shown in FIG. 3, a platen 2 for mounting the recording medium 20 such as a sheet. The first print head 11, the first UV-light irradiating units 12*a* and 12*b*, the second print head 13, the second UV-light irradiating unit 14, and the third UV-light irradiating unit 15 are arranged on an upper side of the platen 2.

The first print head 11, the first UV-light irradiating units 12*a* and 12*b*, the second print head 13, the second UV-light irradiating unit 14, and the third UV-light irradiating unit 15 are integrated by mounting on a unit mount 10. The unit mount 10 is movable over and relative to the recording medium 20 that is mounted on the platen 2, in an X-Y direction that is substantially parallel to the recording medium 20. Specifically, the unit mount 10 is movably supported by a guide rail 3 along a Y (horizontal) direction.

A pressing roller (not shown) and a feed roller (not shown) are arranged facing each other with the upper surface of the platen 2 sandwiched therebetween, and rotatably support the platen 2. Thus, a portion of the recording medium 20 that is mounted on the platen 2 is sandwiched between the pressing roller and the feed roller. The recording medium 20 moves over the platen 2 in the X direction by a rotation of the feed roller in the X direction.

Thus, by moving the unit mount 10 along the guide rail 3 in the Y direction and the recording medium 20 over the platen 2 in the X direction, the unit mount 10 (and the first print head 11, the first UV-light irradiating units 12*a* and 12*b*, the second print head 13, the second UV-light irradiating unit 14, and the third UV-light irradiating unit 15 mounted in the unit mount 10) can be moved as one unit over and relative to the recording medium 20 in the X-Y direction.

The first print head 11, the first UV-light irradiating units 12*a* and 12*b*, the second print head 13, the second UV-light irradiating unit 14, and the third UV-light irradiating unit 15 are moveable individually over and can be relative to the recording medium 20 in the X-Y direction.

The first print head 11 discharges the UV curable colored ink droplets from nozzles (not shown) provided on the lower surface towards the recording medium 20 mounted on the platen 2.

The first print head 11 is an inkjet head that includes basic colors, for example, Y, M, C, K or Y, M, C, K, Lm, and Lc.

A plurality of UV curable colored ink droplets is discharged from the first print head 11 at predetermined timings. The UV curable colored ink droplets are deposited on desired positions on the surface of the recording medium 20 in the form of dots and the images and/or characters formed of the array of the dots 21*a* of the UV curable colored inks are printed on the surface of the recording medium 20.

The first UV-light irradiating units 12*a* and 12*b* are arranged on either side of the first print head 11, and irradiate the UV light towards the recording medium 20 mounted on the platen 2.

The colored-ink layer 21 is irradiated with the weak UV light from the first UV-light irradiating units 12*a* and 12*b*. Consequently, the colored-ink layer 21 is partially cured.

An irradiation energy of the weak UV light irradiated from the first UV-light irradiating units 12*a* and 12*b* can preferably be half of or less than half of an energy required for curing the ink completely. It may be further preferable that the irradiation energy be equal to ⅕ of or less than the energy required for curing the ink completely.

The second print head 13 discharges UV curable clear ink droplets from nozzles (not shown) provided on the lower surface towards the recording medium 20 mounted on the platen 2.

A plurality of UV curable clear ink droplets is discharged from the second print head 13 at predetermined timings. The UV curable clear ink droplets are deposited on desired positions on the surface of the recording medium 20 in a dot shape, and the ink droplets form the clear coat layer 22 that covers the colored-ink layer 21.

Although not to be particularly limited, a resin whose refractive index is the same or substantially the same within an error range of ±0.5 as that of a resin that is the primary ingredient of the UV curable colored ink is desirable as the primary component of the clear ink.

The second UV-light irradiating unit 14 irradiates the weak UV light on the colored-ink layer 21 and the clear coat layer 22. Formation of a hard strip at a boundary of an irradiated portion and a non-irradiated portion can be suppressed by irradiating with the weak UV light from the second UV-light irradiating unit 14 before irradiating with the strong UV light from the third UV-light irradiating unit 15.

The irradiation energy of the weak UV light irradiated from the second UV-light irradiating unit 14 can be preferably half of or less than half of the energy required for curing the ink completely. It is further preferable that the irradiation energy be equal to ⅕ of or less than the energy required for curing the ink completely.

The third UV-light irradiating unit 15 irradiates on the colored-ink layer 21 and the clear coat layer 22 the strong UV light sufficient for completely curing the dots 21*a* of the inks that form the colored-ink layer 21 and the clear coat layer 22.

A xenon lamp or a high-pressure mercury vapor lamp can be used as a UV light emitter included in the first to third UV-light irradiating units. However, in the present disclosure, it is desirable to use a UVLED that can freely control an amount of the UV light with an electric current or a pulse width.

Exemplary embodiments of the printing method according to the present disclosure that uses the inkjet printer 1 described above are explained next.

Figure 4:
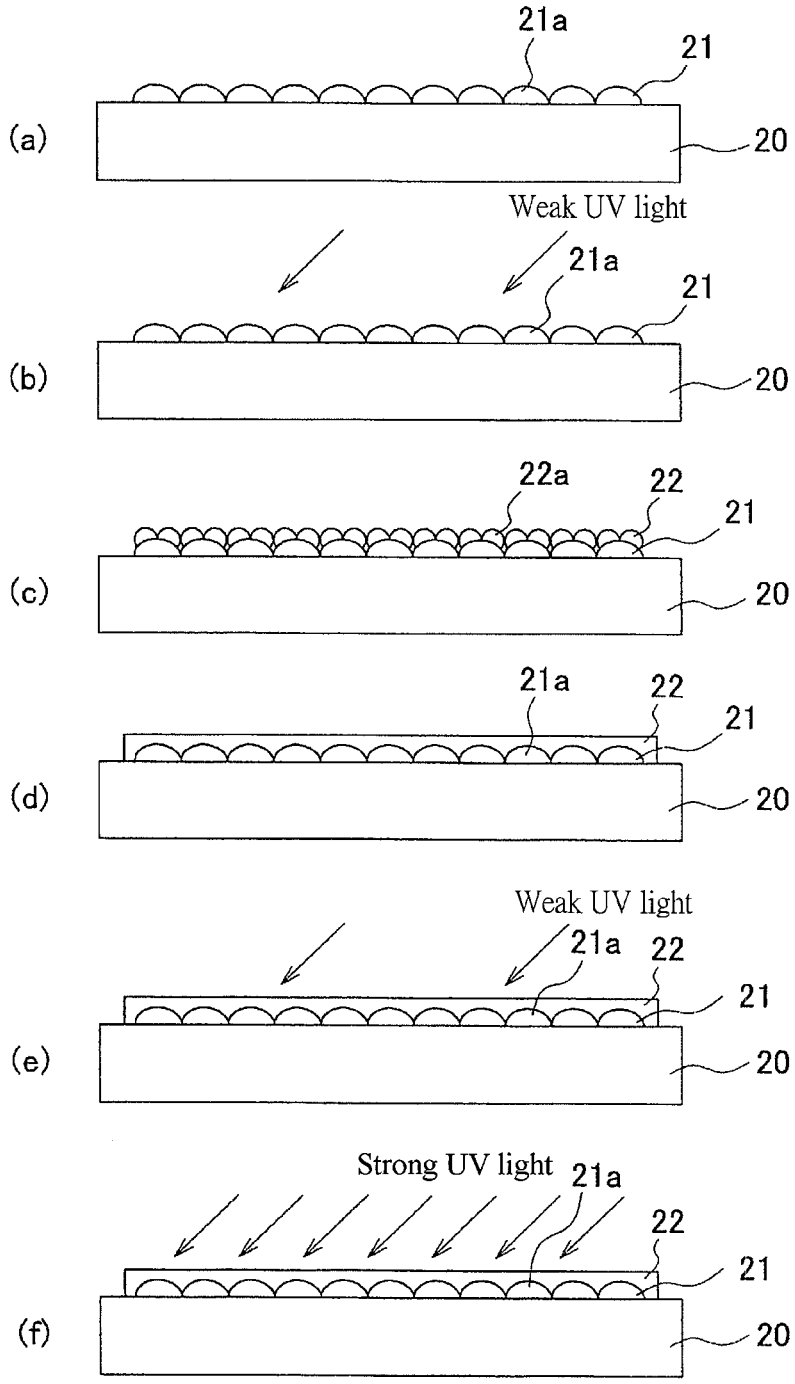
FIG. 4 is a schematic diagram for explaining a processing sequence of a printing method according to the present disclosure.

FIG. 4 is a schematic diagram for explaining a processing sequence of the printing method according to the present disclosure.

The printing method according to the present disclosure sequentially includes Steps (1) to (6) that are described below:

Step (1): Printing the images and/or characters formed of the array of the dots 21*a* of the UV curable colored inks on the surface of the recording medium 20, using the inkjet printer 1 that uses the UV curable ink.

Step (2): Irradiating the colored-ink layer 21 formed of the dots 21*a* of the colored inks with the weak UV light so as not to cure the colored-ink layer 21 completely.

Step (3): Forming the clear coat layer 22 (overprint layer) using the UV curable transparent or semitransparent clear ink (overprint ink) on the colored-ink layer 21.

Step (4): Flattening the surface of the clear coat layer 22 after allowing a predetermined time to elapse.

Step (5): Irradiating the clear coat layer 22 with the weak UV light so as not to cure the colored-ink layer 21 completely.

Step (6): Irradiating the clear coat layer 22 with the strong UV light sufficient for curing the colored-ink layer 21.

In the printing method according to the present disclosure, the surface of the clear coat layer 22 is flattened after allowing a predetermined time to elapse after the clear coat layer 22 is formed on the colored-ink layer 21 that is partially cured, and the colored-ink layer 21 and the clear coat layer 22 are cured. By forming the clear coat layer 22 on the colored-ink layer 21 that is partially cured, a contact angle between the colored ink and the clear ink can be reduced and a better bonding can be achieved between the colored ink and the clear ink. The clear coat layer 22 that is less uneven and less bulging is formed after allowing the predetermined time to elapse.

Thereafter, the clear coat layer 22 having a flat surface is obtained by curing the colored-ink layer 21 and the clear coat layer 22. Thus, scattering of the light can be suppressed on the surface of the dots 21*a* of the inks forming the colored-ink layer 21. The glossiness of the surface of the images and/or characters covered by the clear coat layer 22 can be increased and the quality of the images and/or characters can be enhanced.

As a result, in the present disclosure, the printing method that can increase the bonding between the colored-ink layer 21 and the clear coat layer 22, flatten the surface of the clear coat layer 22, and print the glossy images and the decorative colors can be provided.

The processing sequence of the printing method is explained below.

(1) As shown in (a) in FIG. 4, the droplets of the UV curable colored ink are discharged on the surface of the recording medium 20 and the images and/or characters formed of the array of the dots 21*a* of the colored ink droplets are printed (Step (1)).

In the above described inkjet printer 1 that uses the UV curable ink, the first print head 11 that relatively moves over the recording medium 20, which is mounted on the platen 2, in the X-Y direction that is substantially parallel to the surface of the recording medium 20 discharges the UV curable colored ink droplets at the predetermined timings towards the recording medium 20. The ink droplets are deposited on the surface of the recording medium 20 on the desired positions in the dot shape. Thus, as shown in (a) in FIG. 4, the images and/or characters formed of the array of the dots 21*a* of the UV curable colored inks are printed on the surface of the recording medium 20.

(2) As shown in (b) in FIG. 4, the colored-ink layer 21 formed of the dots 21*a* of the colored inks is irradiated with the weak UV light so as not to cure the colored-ink layer 21 completely (Step (2)).

Furthermore, the images and/or characters printed on the surface of the recording medium 20 are irradiated with the weak UV light from the first UV-light irradiating units 12*a* and 12*b*. The UV light is irradiated from either of or from both of the first UV-light irradiating units 12*a* and 12*b* having controlled a light output such that the weak UV light is output so as not to cure the colored-ink layer 21 completely.

The irradiation energy when irradiating with the weak UV light can preferably be half of or less than half of the energy required for completely curing the UV curable ink. It may be preferable that the irradiation energy be equal to ⅕ of or less than the energy required for completely curing the UV curable ink. Thus, because the viscosity of the color ink increases without the color ink being cured, blurring of the image can be suppressed. Furthermore, the contact angle between the colored-ink layer 21 and the clear coat layer 22 can be reduced, and the bonding between the colored-ink layer 21 and the clear coat layer 22 can be enhanced.

(3) As shown in (c) in FIG. 4, the clear coat layer 22 is formed on the colored-ink layer 21 using the UV curable transparent or semitransparent clear ink (Step (3)).

The second print head 13 that relatively moves over the recording medium 20, which is mounted on the platen 2, in the X-Y direction with the movement of the medium, discharges the UV curable clear ink droplets towards the recording medium 20 at the predetermined timings. The colored ink droplets are deposited in a line on the surface of the recording medium 20 having the images and/or characters printed thereon in the form of dots at a small pitch. At this step, no UV light is irradiated.

Thus, the clear coat layer 22 with dots 22*a* of the UV curable clear inks arranged at a small pitch is formed on the surface of the colored-ink layer 21.

(4) As shown in (d) in FIG. 4, after allowing the predetermined time to elapse, the surface of the clear coat layer 22 is flattened (Step (4)).

Because the colored-ink layer 21 and the clear coat layer 22 that are in the liquid state are in contact with each other, the contact angle between the colored-ink layer 21 and the clear coat layer 22 is extremely small. That is, the clear coat layer 22 does not come off from the colored-ink layer 21 and a better bonding can be achieved. That is, the bonding between the colored-ink layer 21 and the clear coat layer 22 can be enhanced. Because the viscosity of the clear ink is maintained at a low state, the surface of the clear coat layer 22 is flattened after allowing a sufficient time to elapse after the colored ink is printed.

(5) As shown in (e) in FIG. 4, the colored-ink layer 21 and the clear coat layer 22 are irradiated with the weak UV light so as not to cure the colored-ink layer 21 and the clear coat layer 22 completely (Step (5)).

The second UV-light irradiating unit 14 relatively moves over the recording medium 20 mounted on the platen 2, that is, immediately above the clear coat layer 22 in the X-Y direction and the clear coat layer 22 is irradiated with the very weak UV light from the second UV-light irradiating unit 14.

When the strong UV light is irradiated, the irradiated portion hardens, forming a hard strip at the boundary between the irradiated portion and the non-irradiated liquid portion. The hard strip can be prevented from being formed by irradiating with the very weak UV light.

(6) As shown in (f) in FIG. 4, the colored-ink layer 21 and the clear coat layer 22 are irradiated with the strong UV light sufficient for curing the colored-ink layer 21 and the clear coat layer 22 (Step (6)).

The third UV-light irradiating unit 15 relatively moves over the recording medium 20 mounted on the platen 2, that is, immediately above the clear coat layer 22 in the X-Y direction. The strong UV light sufficient for curing the colored-ink layer 21 and the clear coat layer 22 is irradiated from the third UV-light irradiating unit 15 on the clear coat layer 22, and the colored-ink layer 21 and the clear coat layer 22 are cured.

Because the viscosities of the colored-ink layer 21 and the clear coat layer 22 are increased because of the irradiation by the second irradiating unit, and the colored-ink layer 21 and the clear coat layer 22 are partially cured, the hard strip can be prevented from being formed at the boundary of the irradiated/non-irradiated portion even if the third UV-light irradiating unit 15 further irradiates the strong UV light.

Thus, the surface of the colored-ink layer 21 is covered by the transparent or semitransparent clear coat layer 22 that does not get easily peeled off.

No hard strip is formed on the surface of the images and/or characters obtained as described above and scattering of the light can be suppressed on the surface of the dots 21*a* of the inks that form the colored-ink layer 21. Thus, the glossiness of the surface of the images and/or characters covered by the clear coat layer 22 increases and the quality of the images and/or characters can be enhanced.

As a result, in the present disclosure, the bonding between the colored-ink layer 21 and the clear coat layer 22 can be enhanced, the surface of the clear coat layer 22 can be flattened, and it is possible to print glossy images and the decorative colors.

The inkjet printer and the printing method according to the present disclosure have been explained so far. However, the present disclosure is not limited to these examples, various modifications may be made without departing from the spirit or scope of the general inventive concept as defined by the appended claims and their equivalents.

For example, in the above explanation, a case is explained in which the transparent or semitransparent clear ink is used as the overprint ink. However, the present disclosure is not limited to this configuration, and it can be applied to colors such as a metallic ink and a white ink that cannot be mixed. If the clear ink is printed over the images or characters printed using the colored ink but that has not been UV cured, after the passage of a predetermined time, both the inks get intermingled and a glossy print of mixed colors is obtained. Furthermore, special printing such as clear printing on the metallic ink can be performed by printing not only the clear ink but also by simultaneously printing the metallic ink and the white ink.

In the present disclosure, various modifications can be made in the arrangement of the UV-light irradiating units. For example, in a device that performs only one-way printing, either of the first UV-light irradiating units 12*a* and 12*b* can be omitted.

The third UV-light irradiating unit and the second UV-light irradiating unit can be integrated. That is, the functions of the second UV-light irradiating unit can be combined with that of the third UV-light irradiating unit by switching the irradiation intensity of the UV light of the third UV-light irradiating unit between "weak" and "strong". In this case, the second UV-light irradiating unit can be omitted.

The first print head and the second print head can be integrated. That is, the functions of the second print head can be combined with that of the first print head. Furthermore, by bringing the printer at the original position when performing overprinting after the colored ink is printed, the overprint ink can be printed by irradiating with the very weak UV light from the first UV-light irradiating unit or can be printed without irradiating with the UV light. In this case, the second UV-light irradiating unit is not required.

The present disclosure is also applicable to a flatbed printer.

The inkjet printer according to the present disclosure includes a mechanism that controls the irradiation intensity of the UV light from the UV-light irradiating unit in accordance with a print speed that changes with a print mode. Consequently, the present disclosure can be more effectively implemented.

INDUSTRIAL APPLICABILITY

The present disclosure is applicable to the inkjet printer and the printing method that perform overprinting using the UV curable ink (a type of ink that is cured by irradiating with an ultraviolet light).

The invention claimed is:

1. An inkjet printer that uses a UV curable ink, the inkjet printer at least comprising:

a first print head that discharges droplets of a plurality of UV curable colored inks directly on a surface of a recording medium and directly prints images and/or characters formed of an array of dots of the ink droplets;

a first UV-light irradiating unit that irradiates on a colored-ink layer formed of the dots of the colored ink a UV light which partially cures the colored-ink layer;

a second print head that discharges droplets of a UV curable transparent or semitransparent overprint ink on the colored-ink layer, and forms an overprint layer that covers the colored-ink layer;

a second UV-light irradiating unit that irradiates on the overprint layer a UV light which partially cures the overprint layer, after allowing a predetermined time for flattening a surface of the overprint layer elapse after the overprint layer is formed; and a third UV-light irradiating unit that irradiates on the colored-ink layer and the overprint layer a UV light which completely cures the colored-ink layer and the overprint layer after the second UV-light irradiating unit irradiated UV light on the overprint layer.

2. The inkjet printer according to claim 1, wherein the first UV-light irradiating unit and/or second UV-light irradiating unit irradiates a UV light having an intensity that is half of or less than half of that of the UV light irradiated from the third-UV-light irradiating unit.

3. An inkjet printer that uses a UV curable ink, the inkjet printer at least comprising:

a print head that discharges droplets of a plurality of UV curable colored inks directly on a surface of a recording medium and directly prints images and/or characters formed of an array of dots of the ink droplets, and that discharges droplets of a UV curable transparent or semitransparent overprint ink on the colored-ink layer, and forms an overprint layer that covers the colored-ink layer;

a first UV-light irradiating unit that irradiates on a colored-ink layer formed of the dots of the colored ink a UV light which partially cures the colored-ink layer;

a second UV-light irradiating unit that irradiates on the overprint layer a UV light which partially cures the overprint layer, after allowing a predetermined time for flattening a surface of the overprint layer elapse after the overprint layer is formed; and a third UV-light irradiating unit that irradiates on the colored-ink layer and the overprint layer a UV light which completely cures the colored-ink layer and the overprint layer after the second UV-light irradiating unit irradiated UV light on the overprint layer.

4. The inkjet printer according to claim 3, wherein the first UV-light irradiating unit and/or second UV-light irradiating unit irradiates a UV light having an intensity that is half of or less than half of that of the UV light irradiated from the third-UV-light irradiating unit.

5. An inkjet printer that uses a UV curable ink, the inkjet printer at least comprising:

a print head that discharges droplets of a plurality of UV curable colored inks directly on a surface of a recording medium and directly prints images and/or characters formed of an array of dots of the ink droplets, and that discharges droplets of a UV curable transparent or semitransparent overprint ink on the colored-ink layer, and forms an overprint layer that covers the colored-ink layer;

a first UV-light irradiating unit that irradiates on a colored-ink layer formed of the dots of the colored ink a UV light which partially cures the colored-ink layer, and that irradiates on the overprint layer a UV light which partially cures the overprint layer, after allowing a predetermined time for flattening a surface of the overprint layer elapse after the overprint layer is formed; and a third UV-light irradiating unit that irradiates on the colored-ink layer and the overprint layer a UV light which completely cures the colored-ink layer and the overprint layer after the first UV-light irradiating unit irradiated UV light on the overprint layer.

6. The inkjet printer according to claim 5, wherein the first UV-light irradiating unit irradiates a UV light having an intensity that is half of or less than half of that of the UV light irradiated from the third-UV-light irradiating unit.

7. A printing method comprising:

a first step of printing images and/or characters formed of an array of dots of a plurality of UV curable colored inks directly on a surface of a recording medium using an inkjet printer that uses a UV curable ink;

a second step of irradiating a colored-ink layer formed of the dots of the colored inks with a UV light which partially cures the colored-ink layer;

a third step of forming an overprint layer that covers the colored-ink layer using a UV curable transparent or semitransparent overprint ink on the colored-ink layer;

a fourth step of flattening a surface of the overprint layer after allowing a predetermined time to elapse;

a fifth step of irradiating the overprint layer with the UV light which partially cures the overprint layer; and a sixth step of irradiating the colored-ink layer and the overprint layer with a UV light which completely cures the colored-ink layer and the overprint layer.

8. The printing method according to claim 7, wherein an intensity of the UV light which partially cures the colored-ink layer and the overprint layer is half of or less than half of that of the UV light which completely cures the colored-ink layer and the overprint layer.

* * * * *